US006357941B1

(12) United States Patent
Amano et al.

(10) Patent No.: US 6,357,941 B1
(45) **Date of Patent: *Mar. 19, 2002**

(54) PRODUCTION METHOD OF LINERLESS LABEL

(75) Inventors: Tsuneyuki Amano; Naohiro Shirahama; Katsuya Kume; Itsuroh Takenoshita, all of Osaka (JP)

(73) Assignee: Nitto Denko Corporation, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/039,339

(22) Filed: Mar. 16, 1998

(30) Foreign Application Priority Data

Mar. 26, 1997 (JP) ..... 9-93115

(51) Int. Cl.[7] ..... B41J 11/66; B41J 11/70; G09F 3/10; G09F 3/60; B31D 0/02

(52) U.S. Cl. ..... 400/621; 400/613

(58) Field of Search ..... 101/288; 428/343; 400/88, 613, 621

(56) References Cited

U.S. PATENT DOCUMENTS 4,784,714 A * 11/1988 Shibata ..... 156/354
5,292,713 A * 3/1994 Stenzel et al. ..... 503/226
5,487,337 A * 1/1996 Uland ..... 101/288
5,524,996 A * 6/1996 Carpenter et al. ..... 400/621
5,560,293 A * 10/1996 Boreali et al. ..... 400/621
5,674,345 A * 10/1997 Nash ..... 156/264
5,713,679 A * 2/1998 Taylor ..... 400/621
5,725,320 A * 3/1998 Austin et al. ..... 400/621
5,768,991 A * 6/1998 Cless et al. ..... 400/621
5,780,142 A * 7/1998 Kume et al. ..... 428/195
5,823,693 A * 10/1998 Henderson et al. ..... 400/621
5,832,827 A * 11/1998 Pistro et al. ..... 400/621

FOREIGN PATENT DOCUMENTS

JP 8-160861 A * 6/1996

* cited by examiner

*Primary Examiner*—Daniel J. Colilla
(74) *Attorney, Agent, or Firm*—Sughrue Mion, PLLC

(57) ABSTRACT

A method is described for preparing labels from blank stock material comprising printing on demand label information onto a substrate which has a pressure sensitive layer on one surface having relatively low adhesion to the opposite surface of the substrate to be printed and which has been rolled so that the adhesive layer adheres to the surface of the substrate to be printed.

5 Claims, 2 Drawing Sheets

PRODUCTION METHOD OF LINERLESS LABEL

FIELD OF THE INVENTION

The present invention relates to a method for producing a linerless label which can be formed in a roll form without using a release liner for covering a pressure-sensitive adhesive layer. The label can be printed with a pattern, etc., in situ as occasion may demand. The label can be fixed by adhesion to an adherend through the pressure-sensitive adhesive layer.

BACKGROUND OF THE INVENTION

Hitherto, a method of printing while unwinding a label sheet from a roll of the label sheet wherein a pressure-sensitive adhesive layer formed on a substrate to be printed is covered with a release liner has been known. As occasion may demand, various kinds of labels, such as bar-code labels or nameplate labels, can be produced by printing an ink information on a label sheet by a printer in situ and fixing by adhesion the label onto an adherend through a pressure-sensitive adhesive layer previously formed on the label sheet. In this method, a release liner covering the pressure-sensitive adhesive layer is indispensable. Without the release liner it is difficult to unwind the label sheet from the roll thereof, and also the pressure-sensitive adhesive layer adheres to inner parts of the printer, making it impossible to produce labels.

It is also necessary to release the release liner from the pressure-sensitive adhesive layer in adhering the label to an adherend. However, because the release liner is thin and soft, it is difficult to release from the pressure-sensitive adhesive layer. Further, the released release liners are discarded waste articles.

Linerless label sheets without need of a release liner covering the pressure-sensitive adhesive layer have been proposed. These include a delayed tack type, a printed type, a sandwich type or a heat-sensitive coloring type.

However, the delayed tack type has involved problems that a means heating for giving a pressure-sensitive adhesive property is required, and the delayed tack type cannot be placed under high temperature for blocking prevention, etc. The printed type has involved the problem that because this type is pre-printed, labels newly printed in situ as occasion may demand cannot be issued. The sandwich type has involved the problem that it requires a complicated printing mechanism capable of printing on both the front surface and the back surface of the label sheet. The heat-sensitive coloring type has involved problems of poor light resistance, water resistance, chemical resistance, moisture resistance, heat resistance, etc. Disappearance, oozing, blur, etc., of the information given can occur, making it difficult to read the information visually or by a bar-code reader; also this type cannot endure use in open air.

SUMMARY OF THE INVENTION

Accordingly, an object of the present invention is to provide a method for producing a label having excellent durability wherein the label can be formed in situ as occasion may demand. The method involves applying an ink, using a roll of a label sheet having attached thereto a pressure-sensitive adhesive layer in a linerless state, i.e., without having a release liner covering the pressure-sensitive adhesive layer. The label formed can be easily fixed by adhesion to an adherend through the previously attached pressure-sensitive adhesive layer.

According to the present invention, there is provided a production method for a linerless label capable of being formed in situ. The process comprises applying an ink to the back surface of a substrate of a label sheet. The sheet is formed by winding the substrate to be printed having on one surface thereof a pressure-sensitive adhesive layer in such a manner that the pressure-sensitive adhesive layer is releasably adhered to the back surface of the substrate to be printed, and cutting the label sheet thus printed into a definite length.

According to the present invention, a roll of lineress label sheet is used and a durable label can be formed in situ as occasion may demand; the label can be easily fixed by adhesion to an adherend through a pressure-sensitive adhesive layer previously attached to the label sheet. Thus, a release liner conventionally used for covering the pressure-sensitive adhesive layer of a label sheet, becomes unnecessary.

DETAILED DESCRIPTION OF THE INVENTION

The present invention is described in detail below.

The production method of the present invention can obtain a linerless label by applying an ink print to the back surface of a substrate of a label sheet unwound from a roll thereof. The roll is formed by winding the label sheet comprising the substrate to be printed having a pressure-sensitive adhesive layer on one surface thereof in such a manner that the pressure-sensitive adhesive layer is releasably adhered to the back surface of the substrate to be printed. After printing, the label sheet is cut into a definite length. Thus, according to the method of the present invention, labels can be issued in situ from previously unmarked label sheet stock as occasion may demand.

Figure 1:
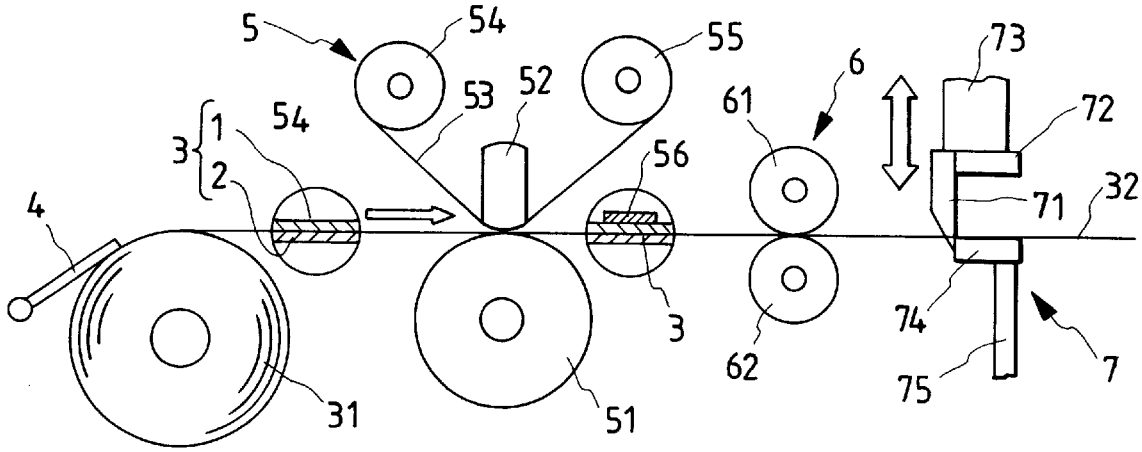
FIG. 1 is a view explaining the production method of the label according to the present invention.

An embodiment of the label issuing apparatus for practicing the present invention is shown in FIG. 1. According to the apparatus shown in FIG. 1, a label sheet 3 is unwound from the roll 31 thereof by means of an unwinding mechanism 6 composed of pinch rolls 61, 62. Using a pair of emboss rolls, the label sheet 3 is introduced into a printing mechanism portion 5. After printing information 56 on the back surface of the substrate to be printed of the unwound label sheet portion, the label sheet 3 thus printed is introduced into a cutting mechanism 7 to cut the label sheet into a definite size, whereby a label 32 can be continuously formed.

Figure 2:
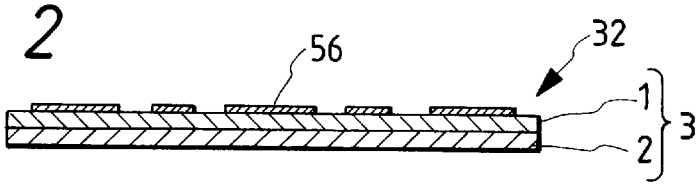
FIG. 2 is a cross-sectional view showing one embodiment of a label and a label sheet.
Figure 3:
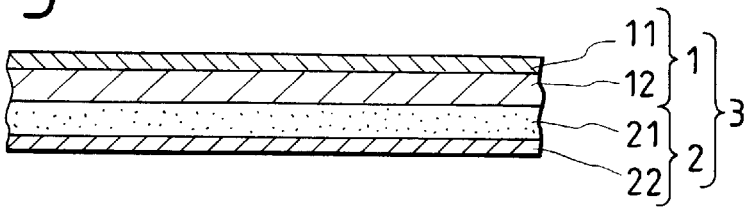
FIG. 3 is a cross-sectional view showing another embodiment of a label sheet.

The label sheet used is a substrate having a pressure-sensitive adhesive layer on one surface thereof. Embodiments of the label sheet are shown in FIG. 2 and FIG. 3. In the drawings, the numeral 1 is a substrate to be printed, 2 is a pressure-sensitive adhesive layer, 11 is a layer to be printed, 12 is a reinforcing layer, 21 is an inner pressure-sensitive adhesive layer, and 22 is an outer pressure-sensitive adhesive layer. In addition, FIG. 2 shows a label 32, and the numeral 56 is ink information applied on the back surface of the substrate 1.

The label sheet may be a sheet-form material comprising a substrate to be printed having a pressure-sensitive adhesive layer on one surface thereof, wherein the back surface of the substrate to be printed and the pressure-sensitive adhesive surface are exposed. Accordingly, the substrate to be printed and the pressure-sensitive adhesive layer each may have an appropriate layer form, such as a single layer or multilayers of 2 layers or 3 or more layers. For example, in the embodiment shown in FIG. 2, the label sheet comprises the substrate 1 to be printed and the pressure-sensitive adhesive layer 2, thus forming a label sheet of a double layer structure. On the other hand, in the embodiment shown in FIG. 3, the substrate to be printed comprises 2 layers including a reinforcing layer 12 for supporting a pressure-sensitive adhesive layer, and the pressure-sensitive adhesive layer 2 comprises 2 layers of an inner pressure-sensitive adhesive layer 21 and an outer pressure-sensitive adhesive layer 22 laminated to each other.

The substrate to be printed receives ink on the back surface thereof and fixes the ink; it also supports a pressure-sensitive adhesive layer formed on the other surface, and releasably adheres to the pressure-sensitive adhesive layer through the back surface of the substrate. The substrate, which can be preferably used in the present invention, is a substrate at least the back surface of which is excellent in the fixing property of ink, has a weak adhesive force with the pressure-sensitive adhesive layer, and does not require a large force for release from the pressure-sensitive adhesive layer.

Examples of the substrate to be printed which can be preferably used in the present invention include a substrate formed by a mixed layer of an ink-receptive resin and a low adhesive resin; a substrate the back surface of which is formed by forming the above-described mixed layers on, for example, a reinforcing layer; a substrate the back surface of which is formed by forming a thin layer or a porous or mesh-form low adhesive resin layer on an ink-receptive layer comprising a paper, a resin or the like; and a substrate the back surface of which is formed by forming such an ink-receptive layer and low adhesive resin layer on, for example, a reinforcing layer thereof.

A substrate to be printed formed by a resin having a low adhesive force with a certain kind of a pressure-sensitive adhesive layer and receptive to a certain kind of a printing ink, and a substrate the back surface of which is formed by forming a layer of such a resin on, for example, the reinforcing layer thereof, can also be preferably used. In this case, a label sheet having a pressure-sensitive adhesive layer having a weak adhesive force with the above-described resin layer is formed into a desired label by printing using the above-described ink receptive with the resin layer.

In the above-described label sheet, resins which can be printed with an appropriate ink, such as a heat-fixing type ink, or a dry-type ink, can be used as the ink-receptive resin used for fixing the ink with good durability, and there is no particular limitation on the resin. Examples of the resin include polyolefins (such as polyethylene or polypropylene), polyamide, polyester, polyvinyl acetate, an ethylene-vinyl acetate copolymer, urethane polymers, acrylic polymers (such as poly(meth)acrylic acid alkyl esters), polyvinyl chloride, styrenic polymers, silicone polymers, plastic and rubber polymers (such as a natural rubber, a polyisobutylene rubber, a polyisoprene rubber, a chloroprene rubber, an isoprene-isobutylene rubber, a nitrylbutyl rubber, a styrene-butadiene rubber, a styrene-butadiene-styrene rubber, a styrene-isoprene-styrene rubber, a styrene-ethylene-ethylene-butadiene rubber, a styrene-isoprene-propylene-styrene rubber, an ethylene-propylene terpolymer, etc.), and their blends.

Examples of the low adhesion resin include resins for releasing coats known as pressure-sensitive adhesive sheets, such as silicone resins, long-chain alkyl resins, fluorine resins, etc.; low molecular weight polyethylenes, phosphoric acid surface active agents, polypropylene, and rubber series polymers. Of those resins, the resins for releasing coat, and particularly silicone resins, can be preferably used.

In forming the mixed layers, the preferred mixing ratio of the ink-receptive resin and the low adhesion resin is that the amount of the low adhesion resin is 0.01 to 10 parts by weight, preferably 0.1 to 8 parts by weight, and more preferably 1 to 5 parts by weight, per 100 parts by weight of the ink-receptive resin.

On the other hand, a method of forming the low adhesion resin on the ink-receptive layer as a thin layer has an objective to maintain the fixing property of ink while achieving decrease of the adhesive force to the pressure-sensitive adhesive layer by a thin layer of the low adhesion resin. In this method, the thickness of the low adhesion resin layer is 0.01 to 10 $\mu$m, preferably 0.05 to 5 $\mu$m, and more preferably 0.1 to 2 $\mu$m.

A method of forming the porous or mesh-form layer comprising a low adhesion resin on the ink-receptive layer has an objective to enable the ink to fix to ink-receptive layer parts (gaps) between the low adhesion resins formed in porous or mesh-form while achieving decrease of the adhesive force to the pressure-sensitive adhesive layer by the low adhesion resin. The proportion of the porous or mesh-form low adhesion resin layer on the ink-receptive layer is 1 to 90%, preferably 2 to 70%, and more preferably 5 to 50%, from the point of above-described object. In this method, the thickness of the low adhesion resin layer is 0.01 to 100 $\mu$m, preferably 0.05 to 50 $\mu$m, and more preferably 0.1 to 20 $\mu$m.

The porous or mesh-form low adhesion resin layer can be formed by an appropriate method, and it is preferred that the gaps between the low adhesive resins are distributed as uniformly as possible. For example, the formation of the porous or mesh-form low adhesion resin layer can be carried out by a method, such as a gravure method, a screen printing method, a pattern-forming method using a photoresist, a conventional porous membrane-forming method by dry method or wet method, a melt blow method, a curtain spray method, or a method of adhering porous or mesh-form films to each other.

Examples of a resin which has a low adhesive property to a certain kind of a pressure-sensitive adhesive layer described above and is receptive to a certain kind of ink include polyolefin resins (such as polyethylene or polypropylene), silicone polymers, rubber polymers, and long-chain alkyl polymers. The molecular weight of the above-described resins can be appropriately determined according to their comparability with an ink. For example, in the case of a polyolefin resin, the molecular weight is preferably 500 to 6,000,000 based on the viscosity average molecular weight from the points of solvent resistance, ink fixing property, etc.

In the above-described label sheet, the formation of the substrate to be printed comprising a resin, or the ink-receptive layer supporting the back layer thereof or the low adhesive resin layer, such as the thin layer or the porous layer, can be carried out by an appropriate method, such as a method of molding one or more kinds of resins, or a coating method. In the film-formation, appropriate additives, for example, a reinforcing material such as fiber; an appropriate pigment (coloring agent) such as silica, titania, alumina, zinc white, zirconia, calcium oxide, or mica; and an antioxidant can be compounded with the resin(s) or the coating composition. The compounding amount of the additive(s) is preferably 30% by weight or less from the point of the printing property.

Because the above-described label sheet can be in the state that the back surface of the substrate to be printed is exposed to one surface and the pressure-sensitive adhesive layer is exposed to the other surface, as shown in FIG. 3, appropriate layers, such as a reinforcing layer 12 or an inner pressure-sensitive adhesive layer. 21, can be interposed between the back layer 11 of the substrate to be printed and an outer pressure-sensitive adhesive layer 22.

The above-described reinforcing layer is used, if required and necessary, according to the purpose of use, etc., of the label for the purpose of, for example, the reinforcement of the substrate to be printed. Accordingly, for the reinforcing layer, an appropriate material, such as a coated layer of a resin, a film, fibers, a cloth, a paper, a nonwoven fabric, a metal foil, a metal net, or a metal wire, can be used. Physical properties, such as heat resistance, of the reinforcing layer may appropriately determined according to the purpose of use, or the like of the label. For example, a reinforcing layer comprising polyester, polyimide, fluorine resin or polyamide can be used. Physical properties of the label sheet or the label can be easily controlled by appropriately selecting the material for the reinforcing layer. Further, a countermeasure according to the need, such as improvement of contrast to an ink information to be printed, etc., can be applied to the reinforcing layer.

The formation of the label sheet having a reinforcing layer can be carried out by an appropriate method, such as a heat-laminating method, or an extrusion coating method, a method of impregnating the reinforcing layer with a solution-form or melted-form material for forming the substrate to be printed, or a method of interposing the reinforcing layer in the substrate to be printed.

Accordingly, the general form of the substrate to be printed includes various kinds of paper sheets; films, sheets, and foamed sheets made of resins: fibers, cloths, and nonwoven fabrics made of resins; laminates using two or more kinds of the above-described materials, such as papers, films, foamed sheets, or cloths; composite sheets using the above-described materials together with a reinforcing substrate, such as a metal foil; and the like. A substrate to be printed having excellent flexibility is preferred from the points of the winding property, the adhesive property to curved surfaces, and the like.

For example, where the label sheet obtained by forming a pressure-sensitive adhesive layer having a low adhesive force on the substrate to be printed comprises a paper, the paper shows a good ink-receptive property, so that a good printing treatment can be applied by various printers, such as a heat-transfer type printer, a ink jet type printer, or a laser beam type printer.

In the substrate comprising a mixed layer of a low adhesion resin, such as a silicone resin, and an ink-receptive resin, such as a polyester resin, or a substrate having an ink-receptive resin layer having formed thereon a thin layer of a low adhesion resin, or in the label sheet comprising a substrate to be printed having such a layer on the reinforcing layer, such as a polypropylene synthetic paper, formed on the substrate, a good printing treatment can be applied by means of a sublimation heat-transfer type printer through an ink ribbon of a sublimating ink, because the mixed layer or the low adhesive resin thin layer can pass the sublimating ink.

Furthermore, in the substrate having a porous layer comprising a low adhesion resin, such as a silicone resin, on an ink-receptive resin layer comprising, for example, a hydrophilic resin, or in the label sheet obtained by forming a general pressure-sensitive adhesive layer, such as an acrylic resin, on a substrate to be printed having such a porous layer on the reinforcing layer, such as a paper, a good printing treatment can be applied by an ink jet type printer.

The thickness of the substrate to be printed or the back layer thereof may be appropriately determined according to, for example, the purpose of use of the label. In general, the thickness thereof is 0.1 to 500 $\mu$m, preferably 0.5 to 100 $\mu$m, and more preferably 1 to 50 $\mu$m, from the points of the ink fixing property, the strength, and the like. Even where the reinforcing layer is used, the thickness of the back layer of the substrate to be printed is at least 0.1 $\mu$m, preferably at least 0.5 $\mu$m, and more preferably at least 1 $\mu$m, from the points of the ink fixing property, the strength, etc.

The pressure-sensitive layer has the function to easily adhere the label formed to an adherend. In the present invention a roll is formed by winding the label sheet without by a release liner in such a manner that the adhesive layer is in contact with the back surface of the substrate to be printed. It is preferred that the adhesive force of the pressure-sensitive adhesive layer to the back surface of the substrate to be printed is preferably 300 gf/50 mm or lower based on the 180° peeling value (releasing speed 300 mm/minute) in order to achieve that the label sheet is easily unwound. In particular, it is preferred to form the pressure-sensitive adhesive layer having the adhesive force to the back surface of the substrate of 1 to 200 gf/50 mm, and preferably from 5 to 150 gf/50 mm, from the points of the automatic unwinding property through a printer, the harmonious property of the adhesive force to an adherend, and the like.

For the formation of the pressure-sensitive adhesive layer, an appropriate pressure-sensitive adhesive can be used, such as a rubber pressure-sensitive adhesive, an acrylic pressure-sensitive adhesive, a silicone pressure-sensitive adhesive, a vinyl alkyl ether pressure-sensitive adhesive, a polyvinyl alcohol pressure-sensitive adhesive, a polyvinyl-pyrrolidone pressure-sensitive adhesive, a polyacrylamide pressure-sensitive adhesive, or a cellulose pressure-sensitive adhesive. The preferred pressure-sensitive adhesive layer is a pressure-sensitive adhesive layer formed using one or more kinds of urethane pressure-sensitive adhesive, the polyester pressure-sensitive adhesive, and the polyamide pressure-sensitive adhesive, from the points of a low adhesive property and retention of the initial adhesive force; thus, the ease of unwinding and stability where a roll of the label sheet is formed, and the stability of adhering and fixing to an adherend, etc.

A specific combination of the above-described substrate to be printed, the pressure-sensitive adhesive layer showing a low adhesive force to the back surface of the substrate, and a printing ink is, for example, a combination of the label sheet prepared by forming the above-described low adhesion pressure-sensitive adhesive layer of the polyolefin pressure-sensitive adhesive, etc., on the substrate to be printed comprising a polyolefin resin layer, if required and necessary, compounded with the low adhesive resin, such as a silicone resin, or comprising the above-described layer further supported with the reinforcing layer, such as a paper, and an ink comprising a polyolefin resin and a coloring agent, melt transferred on the label sheet through an ink ribbon, or the like.

The formation of the pressure-sensitive adhesive layer can be carried out by an appropriate method, for example, by a calender rolling method, etc; a method of forming the pressure-sensitive adhesive layer on a release liner by an appropriate method, such as a rolling method (e.g., calender rolling method), or a coating method (e.g., a doctor blade coating method, or a gravure roll coating method), and transferring the pressure-sensitive adhesive layer onto a surface of the substrate to be printed; and a method of directly coating the pressure-sensitive adhesive layer on a surface of the substrate to be printed.

The thickness of the pressure-sensitive adhesive layer is preferably 0.01 to 500 $\mu$m from the points of attaining a low adhesive force to the back surface of the substrate to be printed, the suitability as a label sheet in mounting on a commercially available printer, etc. Further, the thickness of the pressure-sensitive adhesive layer is 0.5 to 100 $\mu$m, preferably 1 to 50 $\mu$m, and more preferably 2 to 20 $\mu$m when further considering the stable forming property of the pressure-sensitive adhesive layer having a uniform thickness.

The pressure-sensitive adhesive layer can also be formed as a multilayer of two or more pressure-sensitive adhesive layers comprising the same or different pressure-sensitive adhesives as shown in FIG. 3 for the purpose of improving the fixing force to an adherend in forming a label, while maintaining a weak adhesive force to the back surface of the substrate to be printed. In this case, it is preferred that the pressure-sensitive adhesive layer formed in the inner portion has a complex rigidity of $10^4$ to $10^7$ dyne/cm$^2$ at room temperature and a frequency of 1 Hz from the points of preventing flowing out (oozing out) of the pressure-sensitive adhesive layer by binding when formed into a roll, the improvement effect of the fixing force to an adherend, and the like.

For the formation of the inner pressure-sensitive adhesive layer, an appropriate pressure-sensitive adhesive substance, such as the above-exemplified pressure-sensitive adhesives, can be used; a pressure-sensitive adhesive showing a strong adhesive force can be preferably used. The thickness of the inner pressure-sensitive adhesive layer can be appropriately determined according to the necessary fixing force by the purpose of use of the label. The thickness of the inner pressure-sensitive adhesive layer is generally 1 to 500 $\mu$m, preferably 1 to 100 $\mu$m, and more preferably 20 to 50 $\mu$m.

In the present invention, the label sheet is used by winding the label sheet in such a manner that the pressure-sensitive adhesive layer thereof is in contact with the back surface of the substrate to be printed which forms the sheet. In this case, the pressure-sensitive adhesive layer of the roll of the label sheet may be positioned at the outside of the substrate to be printed or at the inside thereof. Winding the label sheet such that the pressure-sensitive adhesive layer is positioned at the inside of the substrate to be printed is preferred from the point of preventing the pressure-sensitive adhesive layer from being stained by attaching dusts by static electricity, etc. By forming the roll of the label sheet, the long label sheet can be placed in a label issuing apparatus in a compact state.

In the label issuing apparatus shown in FIG. 1, the numeral 4 is a static eliminating mechanism (earthing) comprising an electrically conductive plate. This prevents the label sheet to become electrostatically charged by the static electricity generated in unwinding the label sheet 4 from the roll 31 thereof, whereby dust, etc., is liable to attach to the label sheet. The embodiment shown in FIG. 1 shows that the static eliminating mechanism 4 is disposed in contact with the roll 31 near the unwinding portion of the label sheet, which is liable to become a generating source of the static electricity. However, one or more static eliminating mechanism can be disposed at appropriate portions including the roll and the unwinding portion of the label sheet; a guide, a supporting plate, etc., which are disposed, as the occasion demands, at the conveying passageway of the unwound label sheet, can serve as the static eliminating mechanism.

Printing mechanism portion 5 is a heat-transfer type printing mechanism comprising a thermal head 52 disposed on a platen roll 51, an ink ribbon 53, a delivery reel 54, and a winding reel 55. However, the present invention can form an appropriate printing mechanism portion printed with a heat-fixing type ink, a drying type ink, etc., such as an ink jet type printing method or a laser beam printer type printing method.

Further, the unwinding mechanism for smoothly passing the label sheet by unwinding can be an appropriate mechanism other than a pinch roll, such as a belt conveyer system, and a plurality of such mechanisms can be disposed at appropriate positions, such as near the rear portion of the roll 31 or at the front portion of the cutting mechanism 7.

In addition, it is preferred that the length of the label sheet from being unwound from the roll to be cut, that is, the unwound length of the label sheet from the roll, is short, preferably 10 circumferences or less, and more preferably 5 circumferences or less, of the roll in the initial long state, from the point of restraining the occurrence of staining of the printing or printed surface and the pressure-sensitive adhesive layer surface.

The cutting mechanism 7 for making a label by cutting the printed portion of the label sheet may be a mechanism capable of cutting the label sheet at a definite length, and the cutting mechanism can be formed by an appropriate mechanism, such as a mechanism of intermittently operating a cutting edge by controlling via a cum.

In the embodiment shown in FIG. 1, the cutting mechanism 7 comprises a cutting edge 71, a holding stand 72 for supporting the cutting edge, a linked plate 73 for fixing the holding stand, a receiving stand 74 disposed opposing to the holding stand, and a support 75 composed of, for example, a housing for fixing the receiving stand. The cutting edge 71 is vertically moved together with the holding stand 72 in a body as shown by an arrow via the linked plate 73 intermittently linked with a driving source disposed outside the system interlocking with the above-described printing mechanism 5, whereby the label sheet placed in the receiving stand 74 is cut.

Figure 4:
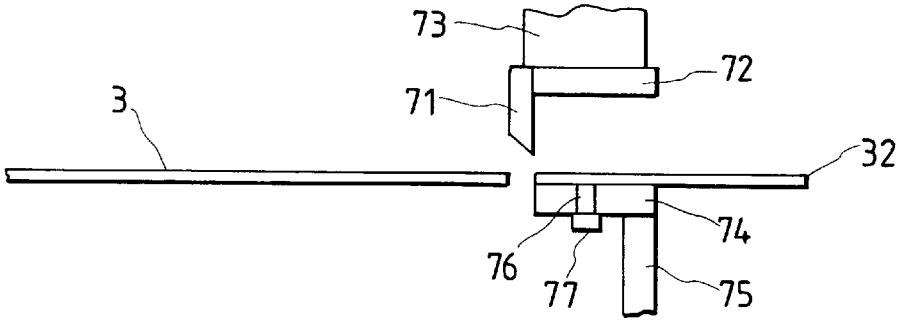
FIG. 4 is a schematic view explaining a cutting mechanism.

In the cutting mechanism 7 shown in FIG. 1, the receiving stand 74 temporarily fixes the label 3 obtained by cutting the label sheet 3 after printing by adhering and supporting via the entire surface or a part of the pressure-sensitive adhesive layer as shown in FIG. 4, whereby falling down the label can be prevented to give facilities for the label in adhering to an adherend. In addition, the temporary fixing mechanism of the label is not limited to the mechanism shown in the drawings, but it is preferred that the surface of the temporary fixing mechanism, which is adhered to the pressure-sensitive adhesive layer surface of the label, is formed with a material having an adhesive force to the label of 300 gf/50 mm or lower, preferably 200 gf/50 mm or lower, and more preferably 150 gf/50 mm or lower, from the points of the release/recovery property of the label, damage prevention of the label in releasing, and the like.

In the present invention, in addition to the above-described temporary fixing mechanism, a mechanism of stopping subsequent printing until the label adhered to the adhering site of the temporary mechanism is removed and further a mechanism that when the label adhered to the adhering site thereof is removed, subsequent printing is automatically started to form the subsequent label, can be added, if necessary. Addition of these mechanisms makes it possible to prevent adhering the labels to each other and to prevent the occurrence of sheet clogging at the label outlet, and further to efficiently conduct the adhering work of the same pattern-printed labels and printed labels of consecutive numbers to adherends without mistake.

In the apparatus of the above-described embodiment, as shown in FIG. 4 a through-hole 76 is formed in the receiving stand 74 in the cutting mechanism 7, a sensor 77 of, for example, an infrared type, is disposed at the back surface thereof, whereby the presence or absence of a label on the receiving stand 74 is detected by the sensor, the signal thus detected is sent to the unwinding mechanism of the roll and the controlling portion of the printing mechanism to thereby stop subsequent printing when a label exists on the receiving stand. When the label is removed, the signal is sent to the controlling portion of the printing mechanism and the unwinding mechanism to thereby start again subsequent printing and unwinding of the label sheet from the roll.

The present invention can use a method of directly adhering the label obtained by cutting the label sheet to a desired adherend through the pressure-sensitive adhesive layer, in place of the above-described temporary fixing system. Such a direct adhering mechanism can be attained by a mechanism according to a conventional labeler, etc.

Ink information applied to the label sheet by the printing mechanism can be formed by optional letters, figures, marks, etc., such as print patterns, design patterns, or bar-code patters. Accordingly, appropriate information labels, such as identification labels, can be formed. Also, a single label or a definite number of labels can be issued in situ as occasion may demand. In addition, patterns which are not required to print in situ as occasion may demand, such as formats of a fixed form, logo marks, fixed-form letters, ground designs, etc., can be previously printed onto the label sheet.

In the label issuing apparatus described above, it is preferred that the conveying portion, etc., which is brought into contact with the pressure-sensitive adhesive layer of the label sheet is treated so that such a portion has a weak adhesive force to the pressure-sensitive adhesive layer according to the above-described temporary fixing mechanism. Such a treatment can be carried out by an appropriate method, such as use of rolls made of a polyolefin, a silicone resin, etc.; a coating method of a polyolefin, a silicone resin, or a fluorine resin; a covering treatment by baking, etc.

Also, it is preferred that the low adhesive force imparting treatment is applied to the whole portions including the sheet outlet of the portion which is brought into contact with the pressure-sensitive adhesive layer of the label sheet, etc., in the label issuing apparatus. For example, in the apparatus shown in FIG. 1, the platen roll 51 in the printing mechanism 5 and the roll 62 of the lower side in the unwinding mechanism 6 are the object for the low-adhesive force imparting treatment. In addition, it is preferred from the smoothness of conveying the label sheet that the conveying passageway, etc, which are brought into contact with the pressure-sensitive adhesive layer of the label sheet, are formed movably by rolls, belts, and the like.

It is preferred that the label issuing apparatus for practicing the method of the present invention is covered by a housing to restrain staining the printing surface and the pressure-sensitive adhesive surface of the label sheet exposed to air. In particular, it is preferred that at least 90% of the total conveying length of the surface portion (outermost layer portion) of the roll of the label sheet, the unwound portion of the label sheet and the label obtained by cutting the label sheet are covered by a housing. Also, it is preferred that the area of open portions, such as the label outlet, or a cooling air sending hole, in the housing is 20% or lower of the outer surface area of the housing.

Figure 5:
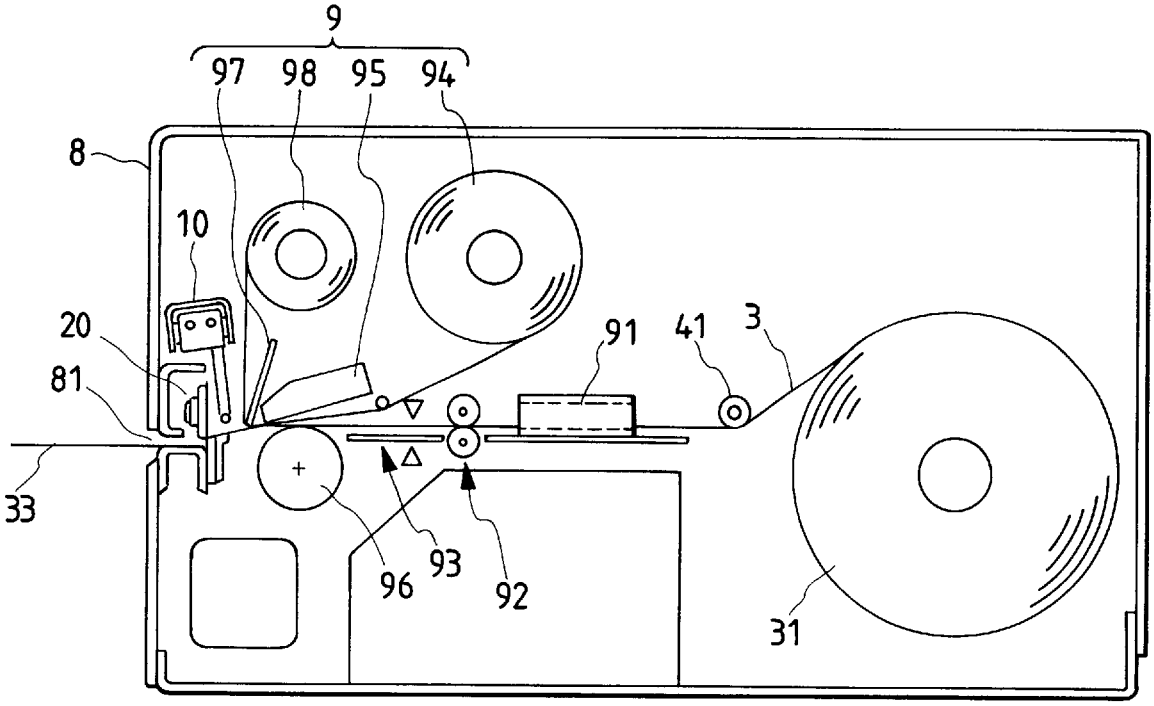
FIG. 5 is a view showing one embodiment of a label issuing apparatus in the present invention.

For example, a heat-transfer type label issuing apparatus (printer) having formed thereon a housing is shown in FIG. 5. The printer is for producing a bar-code label, and the numeral 8 is the housing. According to the printer, a label sheet 3 is continuously unwound from a roll 31 of the label sheet by conveyer rolls 92 made of polyolefin via a static eliminating roll 41 made of a metal and a guide 91 made of polyolefin for positioning the width direction in the printer, and is introduced into a printing mechanism 9 composed of an ink ribbon 94, a thermal head 95, and a polyolefin-coated platen roll 96 via a sensor 93 detecting the end position of the label sheet.

In the printing mechanism portion, the ink of the ink ribbon is melted by the heat generated by a thermal head operated based on printing data (not shown), the molten portion of the ink is heat-transferred onto the back surface of the substrate to be printed of the label sheet by means of a platen roll, a desired bar-code pattern is fixed, the ink layer of the ink ribbon adhered to the back surface of the substrate to be printed is separated from the ink ribbon by means of a releasing plate 97 and printed on the back surface of the substrate, and the ink ribbon thus separated is wound round a recovery reel 98.

The label sheet after printing is detected by a detecting mechanism 10, reaches a cutting mechanism 20 interlocking with the detecting mechanism, and cut in the width direction of the label sheet to form a bar-code label composed of the cut piece of the label sheet.

Figure 6:
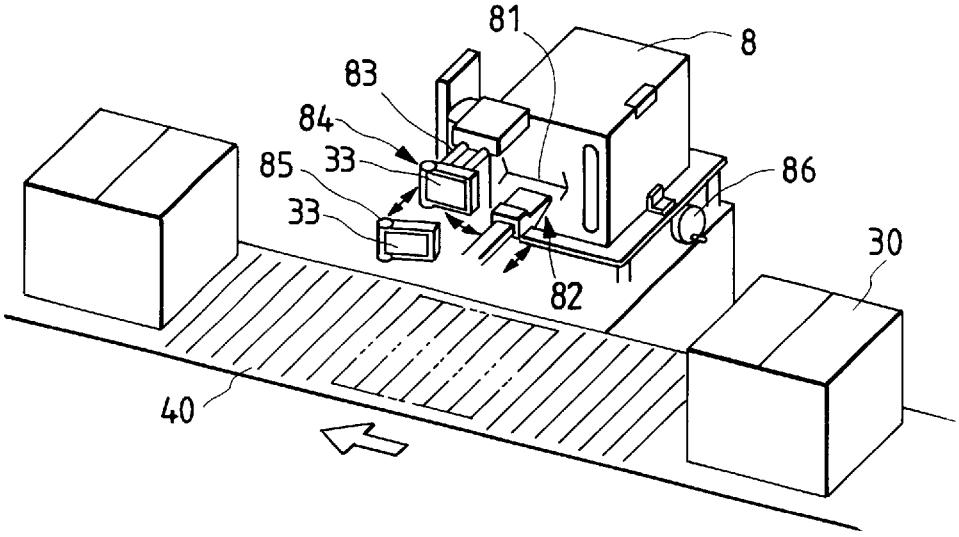
FIG. 6 is a view showing a label adhering mechanism.

The bar-code label after inspection is supplied on a receiving stand 82 from an outlet 81 of the housing 8 as shown in FIG. 6. The receiving stand 82 is controlled such that the bar-code label supplied from the printer 8 is delivered to an adhering head 84 formed at the tips of movable arms 83 disposed outside the printer via back and forth movement and the rotation movement of the receiving stand as shown by arrows.

For the delivery action of the above-described receiving stand, the adhering head 84 recovers by holding the bar-code label 33 by suction, etc., and is controlled by a controlling portion such that the adhering head approaches an adherend 30 conveyed by a belt conveyer 40 by the back and forth movement thereof as shown by an arrow and fixes by adhering the bar-code label 33 to the adherend 30 via a roll portion 85 of the adhering head, whereby the bar-code label formed by the printer is directly adhered to the adherend, In the above-described method, when the bar-code label is a defective label, the receiving stand 82 moves onto a collection box (not shown) based on the memory of the controlling portion by the above-described detecting mechanism and places the label in the waste collection box. In this case, the belt conveyer 40 is stopped by receiving the signal generated from the controlling portion of the label issuing apparatus. In addition, the numeral 86 in FIG. 6 shows a handle for controlling the adhering position of the label.

While the invention has been described in detail and with reference to specific embodiments thereof, it will be apparent to one skilled in the art that various changes and modifications can be made therein without departing from the spirit and scope thereof.

What is claimed is:

1. A method for preparing a printed label form on unprinted label sheet comprising:

a. providing a substrate having an ink-receptive surface to be printed and an opposite surface, wherein the substrate comprises an ink-receptive resin and a low adhesion resin;

b. applying to said opposite surface an adhesive layer having low adhesion to said surface to be printed, wherein the adhesion force of the low adhesion layer to the surface of the substrate to be printed is from 5 to 300 gf/50 mm;

c. winding the coated substrate into a roll of label sheet wherein the low adhesion layer is in direct contact with the surface of the substrate to be printed;

d. unwinding the roll of label sheet such that the surface of the adhesive layer faces downward, and printing desired information on the ink-receptive surface; and e. cutting the printed label sheet to form printed labels, wherein a label issuing apparatus having a housing is provided and at least 90% of the total length of a conveying passageway through which i) the surface portion of the roll of the label sheet, ii) the unwound portion of the label sheet and iii) the label obtained by cutting the label sheet, are conveyed, is covered by said housing, and the area of opening portions of the housing is 20% or less of the outer surface area of said housing.

2. The method of claim 1 wherein said ink-receptive surface has formed thereon a porous or mesh-form low adhesion resin.

3. The method of any of claims 1, or 2, further including providing a label issuing apparatus having a mechanism for adhering the label to a site.

4. The method of any of claims 1, or 2, including providing a label issuing apparatus having a mechanism for adhering the low adhesion surface of a label to a desired adherend.

5. The method of any of claims 1, or 2, wherein an unwound length of the label sheet from the roll of the label sheet is 10 circumferences or less of the roll of the label sheet in the initial length state.

* * * * *